US005241292A

United States Patent [19]

Bjorknas et al.

[11] Patent Number: 5,241,292

[45] Date of Patent: Aug. 31, 1993

[54] THREE POSITION ELECTRICALLY OPERATED ACTUATOR

[75] Inventors: John I. Bjorknas, North Vancouver; Peter J. Druet, Surrey, both of Canada

[73] Assignee: Prime Mover, Inc., Burnaby, Canada

[21] Appl. No.: 889,890

[22] Filed: May 28, 1992

[51] Int. Cl.[5] ..... H01F 3/00; H01F 7/08

[52] U.S. Cl. ..... 335/256; 335/260; 335/264; 335/238; 74/625

[58] Field of Search ..... 335/148-150, 335/222-226, 238, 249, 251, 255-264, 266-268, 270-279, 281, 282; 74/625; 310/22-24, 30, 34, 35

[56] References Cited

U.S. PATENT DOCUMENTS

| | | | |
|---|---|---|---|
| 3,017,546 | 1/1962 | Bates . | |
| 3,119,940 | 1/1964 | Pettit et al. . | |
| 3,172,630 | 3/1965 | Goodman . | |
| 3,219,854 | 11/1965 | McLauglin . | |
| 3,836,879 | 9/1974 | Frye | 335/266 |
| 4,018,344 | 4/1977 | Leshem | 214/133 |
| 4,238,991 | 12/1980 | Pickles | 92/85 A |
| 4,417,448 | 11/1983 | Horn et al. | 310/35 |
| 4,468,594 | 8/1984 | Jacquemet | 310/23 |
| 4,569,239 | 2/1986 | Shirley | 74/625 |
| 4,711,158 | 12/1987 | Kayyod et al. | 92/94 |
| 4,854,188 | 8/1989 | Griffiths | 74/625 |
| 4,891,994 | 1/1990 | Barba | 74/2 |
| 4,920,816 | 5/1990 | Inabe et al. | 74/424.8 A |
| 5,012,725 | 5/1991 | Leary | 92/63 |
| 5,138,291 | 8/1992 | Day | 335/258 |

*Primary Examiner*—Leo P. Picard
*Assistant Examiner*—Raymond Barrera
*Attorney, Agent, or Firm*—Graham & James

[57] ABSTRACT

A three position electrically operated actuator has a self centering system so that if power is off for the actuator, it returns to a central position. The actuator comprises a center cavity with a first solenoid on one side and a second solenoid on the other side, a shaft extends through the center cavity and is joined to a first magnetic core of the first solenoid and a second magnetic core for the second solenoid. The shaft has a connection at least at one end for connection to a gearbox or the like. When the first solenoid is energized the shaft moves axially in one position so the connection is at a first position, when the second solenoid is energized, the shaft moves axially in the opposite direction so the connection is at a second position. A coil spring is provided in the cavity, and when neither solenoid is energized the spring moves the shaft so the connection is in a third position midway between the first position and the second position.

3 Claims, 3 Drawing Sheets

THREE POSITION ELECTRICALLY OPERATED ACTUATOR

TECHNICAL FIELD

The present invention relates to an actuator which is electrically operated, preferably by a solenoid, and has a neutral position which is engaged when the power is off. The actuator is suitable for marine gearbox applications.

BACKGROUND ART

In marine applications wherein a gearbox is used to change the direction of rotation for propeller shafts, actuators are generally used to change the gear drive arrangement. In most cases gearboxes have three positions, forward propulsion, reverse propulsion and neutral.

Actuators presently used for changing gear drives in marine applications may be hydraulic or pneumatic operated. Provisions are made in certain instances for returning the gear change lever to the neutral position if there is a sudden loss of hydraulic or pneumatic pressure. This avoids situations where a power breakdown leaves the propulsion engaged.

Up until the present time there has been no electrically operated actuator which has a self centering arrangement so that if there is a power failure the actuator returns a gear change lever to the neutral position. There is definitely a requirement for such an actuator control for safety reasons and to permit the use of electrical power for controlling a ship thus avoiding the necessity of having to have either pneumatic or hydraulic controls.

DISCLOSURE OF INVENTION

It is an aim of the present invention to provide an electrically operated self centering three position actuator with an end connection suitable for use in connecting to a gear change lever for a marine gearbox. The actuator has two electrical solenoids, one solenoid to move the end connection to a first position, the second solenoid to move the end connection to a second position. A self centering spring is provided to move the end connection to a neutral or third position being a third position when both the solenoids are de-energized. Thus, should a power failure occur when the end connection is in either the first or the second position, the spring automatically returns the end connection to the neutral or third position which is arranged to be the neutral position for the gear change lever.

The present invention provides a three position electrically operated actuator comprising a center cavity with a first solenoid on one side and a second solenoid on the other side, a shaft extending through the center cavity and joined to a first magnetic core of the first solenoid and a second magnetic core of the second solenoid, the shaft having connection means at least at one end, the first solenoid when energized adapted to move the shaft axially in one direction to position the connection means at the end of the shaft in a first position, the second solenoid when energized adapted to move the shaft axially in the opposite direction to position the connection means at the end of the shaft in a second position, spring means within the center cavity, flange means located about the shaft on both sides of the spring means, the flange means compressing the spring means when the shaft is moved axially to locate the connection means in the first position or the second position, and upon deactivation of the solenoids, the spring means moving the shaft so the connection means at the end of the shaft is moved to a third position midway between the first position and the second position.

BRIEF DESCRIPTION OF DRAWINGS

In drawings which illustrate embodiments of the present invention.

Figure 1:
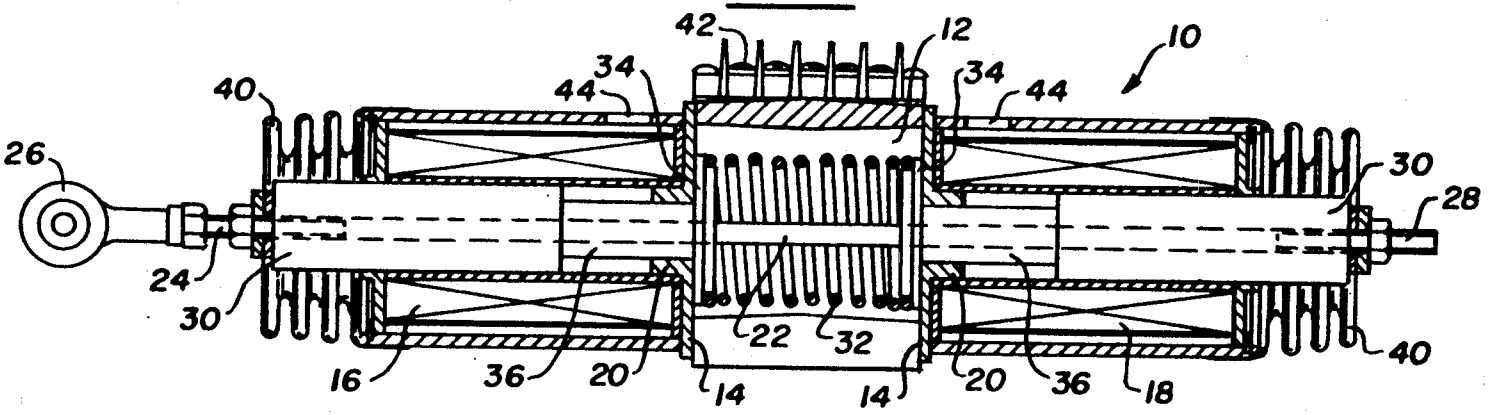
FIG. 1 is a sectional longitudinal view showing a three position electrically operated activator according to one embodiment of the present invention.
Figure 2:
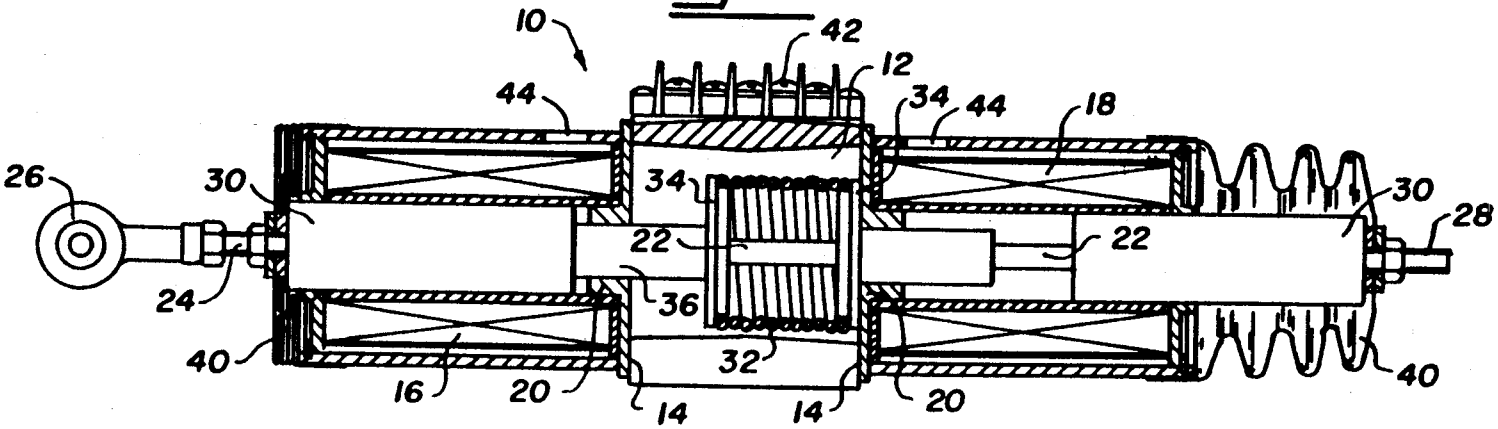
FIG. 2 is a sectional longitudinal view showing the three position electrically operated activator of FIG. 1 with one of the solenoids energized so the connection end is moved away from a central position.

The three position electrically operated actuator 10 shown in FIGS. 1 and 2 has a center cavity 12 with side walls 14 on both sides to which are attached a first solenoid 16 and a second solenoid 18. The side walls 14 both have bosses 20. A central shaft 22 extends through both solenoids 16 and 18 and the center cavity 12. At one end the shaft 22 has a stud connection 24 to a connection link 26 which becomes the connection for the actuator 10. It is this connection link 26 which is connected to a gearbox (not shown).

A further stud connection 28 is located at the other side of the shaft 22. The studs 24 and 28 and the shaft 22 are joined to cylindrical magnetic cores 30 by which represent the solenoid cores for the solenoids 16 and 18. The shaft 22 passes through the cores and joined to the cores by screw threads. A compression coil spring 32 is positioned in the cavity 12 about the shaft 22 and has flange collars 34 having flange diameters about the same size as the coil spring 32 positioned on both sides of the coil spring 32. The flange collars 34 have cylindrical portions 36 integral therewith which slide in aperture in the walls 14 of the cavity 12 when either solenoid is energized.

Expandable rubber protective covers 40 are provided on both sides of the solenoids 16 and 18 connected to the studs 24 and 28 exteriorly of the solenoid magnetic cores 30 to protect dirt from getting on the cores 30 when the shaft 22 moves.

Electrical terminals 42 are provided on the cylindrical exterior of the cavity 12 for electrical connections to the magnetic coil windings of the solenoids 16 and 18 through apertures 44 in their exterior shell. The center cavity 12 is preferably sealed to prevent dirt entering therein.

In operation when neither solenoid is energized, the connection link 26 is in the neutral or third position as shown in FIG. 1, and the spring 32 pushes against both flange collars 34 so the cylindrical portions 36 push against the two solenoid magnetic cores 30. The compression spring 32 is fully expanded and the actuator is stable in the neutral or third position.

FIG. 2 shows first solenoid 16 energized, the solenoid magnetic core 30 immediately moves to the right. The cylindrical portion 36 and flange collar 34 also move to the right compressing the spring 32. The shaft 22 being connected to the magnetic core 30 also moves to the right, so the connection link 26 moves to a second position which when connected to a gearbox may represent either forward or reverse for a marine drive. The second solenoid 18 is not energized when the first solenoid 16 is energized so the solenoid core 30 for the second solenoid 18 simply moves because it is connected to shaft 22. The first solenoid 16 has sufficient power to compress the spring and provide sufficient force to move the connection link 26.

When the solenoid 16 is de-energized the spring 32 immediately pushes the flange collar 34, cylindrical portion 36 and solenoid magnetic core 30 to return the shaft and the connection link 26 to the neutral or third position. When the second solenoid 18 is energized, the first solenoid 16 is not energized and the shaft 22 moves in the other direction moving the connection link 26 to a first position. Thus, three positions are provided, the first and second positions when the two solenoids 16 and 18 are energized, and the neutral or third position when both solenoids are not energized and the spring 32 returns the shaft 22 and the connection link 26 to the third or neutral position.

Figure 3:
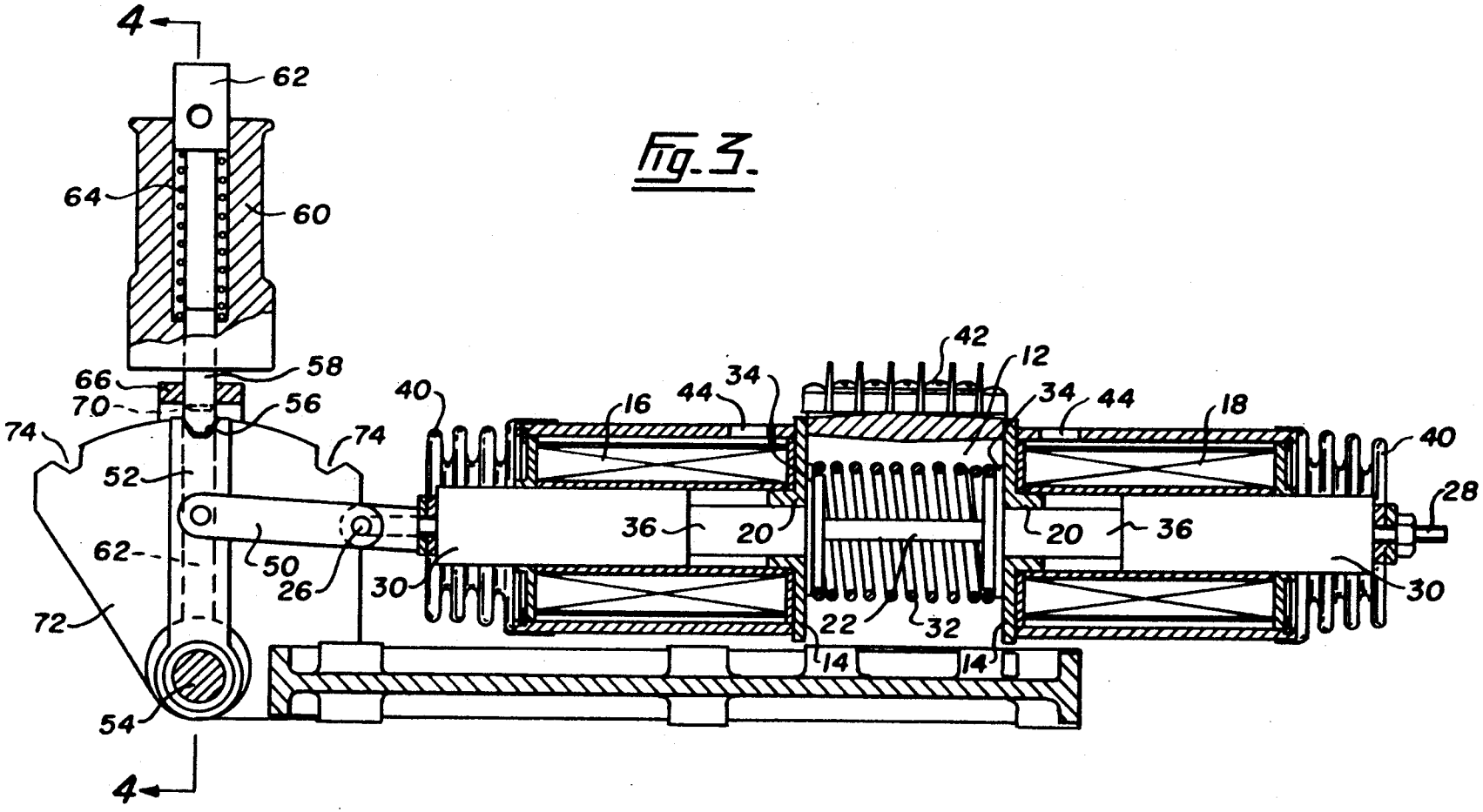
FIG. 3 is a sectional longitudinal view showing another embodiment of a three position electrically operated activator having a manual operating mechanism to position the connection end.
Figure 4:
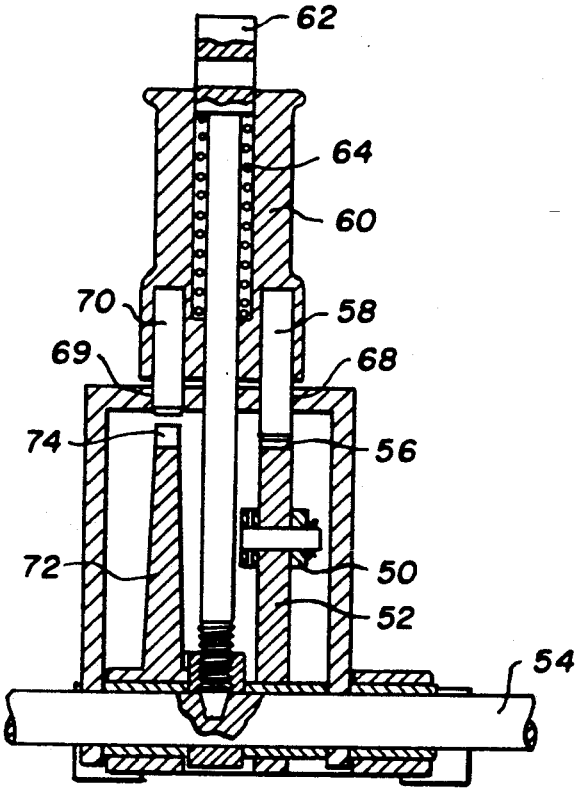
FIG. 4 is a sectional view taken at line 4—4 of FIG. 3.

Another embodiment is shown in FIGS. 3 and 4 wherein a manual override mechanism is provided to change positions of the actuator should there be a power failure and neither of the solenoids 16 or 18 can be energized. The connection link 26 is joined to connecting links 50 which rotates freely around output shaft 54. On top of the input lever 52 is a notch 56 into which fits a latch plunger 58 as shown in FIG. 4. The latch plunger 58 is connected to a manual handle 60 concentric about a manual lever 62, and spring loaded with a coil spring 64 which maintains the latch plunger 58 in the notch 56 in the input lever 52. The manual lever 62 fits into the output shaft 54 at its base so that when the lever 62 is pivoted about the output shaft 54, the output shaft rotates and changes gears.

A latch lever 66 acts as a guide and rotates about the shaft 54 with the manual lever 62 joined to it. Apertures 68,69 are provided on both sides of the manual lever 62 in the latch lever 66. One aperture 68 contains the latch plunger 58 which extends down to engage in notch 56 and a second short plunger extends down from the handle 60 passing only through the aperture 69 in the latch lever 66.

Beneath the second aperture 69 is a sector latch plate 72 which is fixed and has notches 74 representing the three positions of the actuator.

When the handle 60 is in the position shown in FIG. 4, the connecting links 50 move the input lever 52 when the actuator moves between positions, and the input lever 52 through the latch plunger 58, handle 60 and manual lever 62 changes the gears by rotation of the output shaft 54.

If there is a power failure, or if there is a need to operate the gear change manually, the handle 60 is raised, compressing spring 64 until the latch plunger 58 is free of the notch 56 and the aperture 68 in the latch lever 66. The handle 60 is then rotated about the manual lever 62 and then released so the latch plunger 58 passes through aperture 69 and engages in one of the notches 74. The actuator mechanism is then completely disconnected from the output shaft 54. The handle 60 can then be pivoted to any of the three positions, engaging in one of the three notches 74 in the latch plate 72 thus changing gears manually.

In order to re-engage the actuator, the handle 60 is raised and rotated through 180° so the latch plunger 58 again engages in the notch 56 in the input lever 52.

Various changes may be made to the embodiments shown herein without departing from the scope of the present invention which is limited only by the following claims.

The embodiments of the present invention in which an exclusive property or privilege is claimed are defined as follows:

1. A three position electrically operated actuator comprising:

a center cavity with a first solenoid on one side and a second solenoid on the other side;

a shaft extending through the center cavity and joined to a first magnetic core of the first solenoid and a second magnetic core of the second solenoid, the shaft having connection means at least at one end;

the first solenoid when energized adapted to move the shaft axially in one direction to position the connection means at the end of the shaft in a first position;

the second solenoid when energized adapted to move the shaft axially in the opposite direction to position the connection means at the end of the shaft in a second position;

single coiled spring extending between two walls of the center cavity;

two tubular collars positioned about the shaft and extending through apertures in the walls of the cavity;

a flange on each collar, the flange having substantially the same diameter as the coiled spring, the flange positioned on each end of the coiled spring between the end of the spring and the wall;

each flange compressing the coiled spring when the shaft is moved axially to locate the connection means in the first position or the second position; and upon deactivation of the solenoids, the coiled spring pushes each flange into contact with the walls of the center cavity to move the shaft so the connection means at the end of the shaft is moved to a third position midway between the first position and the second position.

2. The three position electrically operated actuator according to claim 1 wherein the shaft extends exteriorly from the first solenoid and the second solenoid and has expandable protection covers thereon.

3. The three position electrically operated actuator according to claim 1 including manual operating lever means exterior of the actuator connected to the shaft, the lever means adapted to disconnect the actuator and permit manual operation.

* * * * *